United States Patent [19]

Reed

[11] Patent Number: 4,608,718

[45] Date of Patent: Sep. 2, 1986

[54] CALF, ANKLE AND FOOT PROTECTOR FOR BASEBALL BATTERS

[76] Inventor: James M. Reed, 2071 Westfall Rd., Rochester, N.Y. 14618

[21] Appl. No.: 769,517

[22] Filed: Aug. 26, 1985

[51] Int. Cl.[4] ..... A41D 13/06

[52] U.S. Cl. ..... 2/22

[58] Field of Search ..... 2/22, 23, 16

[56] References Cited

U.S. PATENT DOCUMENTS

| | | | |
|---|---|---|---|
| 2,982,968 | 5/1961 | Groot | 2/22 |
| 3,416,156 | 12/1968 | Marvid | 2/22 |
| 3,585,639 | 6/1971 | Enicks | 2/22 |
| 3,621,489 | 11/1971 | Keller | 2/22 |
| 3,772,704 | 11/1973 | Carbonneau | 2/22 |
| 3,877,077 | 4/1975 | Chapdelaine | 2/22 |

*Primary Examiner*—Louis K. Rimrodt

*Attorney, Agent, or Firm*—Martin LuKacher

[57] ABSTRACT

Baseball batters are protected from injury to their foot and calf from foul tips by a protector using a integral pad, body of cushioning material which extends from the calf over the foot and has a neck portion which is flexible and provides a hinge so that the protector does not interfere, when the batter must run the bases. Rigid plates over the cushioning material cover the upper and lower sections of the pad on opposite sides of the neck. Straps are connected to these rigid members and are used to secure the protector to the calf and foot area of the batter.

9 Claims, 4 Drawing Figures

CALF, ANKLE AND FOOT PROTECTOR FOR BASEBALL BATTERS

DESCRIPTION

This invention relates to athletic safety devices, and particularly to an improved protector for baseball batters.

The invention is especially suitable for use as a calf ankle and foot protector which is attached to the calf and foot areas of a baseball batter when he is standing at the plate and protects those areas from damage due to foul tips.

Various ankle and shin bone guards have been suggested to avoid injuries commonly suffered by players when at bat by being struck in exposed areas by foul tips or even by misdirected pitches. In this connection reference may be had to U.S. Pat. No. 3,416,156 issued Dec. 17, 1968 for an ankle and shin bone guard. The problem with protectors for the calf, ankle and foot area is interference with the free articulation of the ankle and foot. Such protectors are either limited in the area which they protect, as with the protector of the above-referenced patent which covers only the ankle and shin bone area, or they are impractical since they interfere with the movement of the foot and prevent free running. In the game of baseball this is totally disastrous since the batter must immediately run the bases after hitting the pitch.

Accordingly, it is the principal object of the present invention to provide an improved calf, ankle and foot protector for baseball batters.

It is a more specific object of the invention to provide an improved calf, ankle and foot protector for athletic use which does not interfere with running while protecting both the calf and ankle and foot areas when worn.

Briefly described, an improved calf, ankle and foot protector in accordance with the invention utilizes a flexible body or pad of cushioning material with a first section for protecting the calf and ankle and a second section for protecting the foot, and with a neck between the first and second section which provides a flexible hinge interconnection between the first and second sections. The neck and the first and second sections are integral with each other. There is a first plate of rigid material having a curvature conforming to the calf which is attached over the first section. A second plate of rigid material having a curvature conforming to the foot is attached to the second section. This second plate and the second section desirably extends between the toe and the heel of the foot and along the arch of the foot. The plates are disposed on opposite sides (above and below) of the neck. Means are provided for attaching the first section and first plate to the calf and for attaching the second section and second plate to the foot leaving the neck free to flex with movement of the foot ankle and calf.

Figure 1:
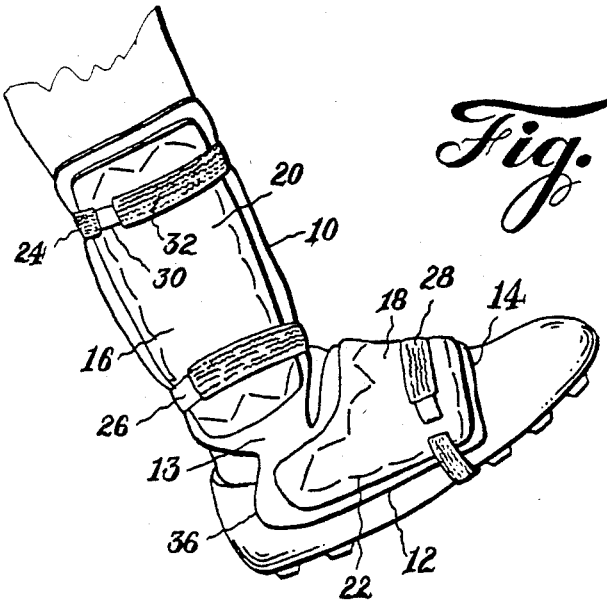
Figure 2:
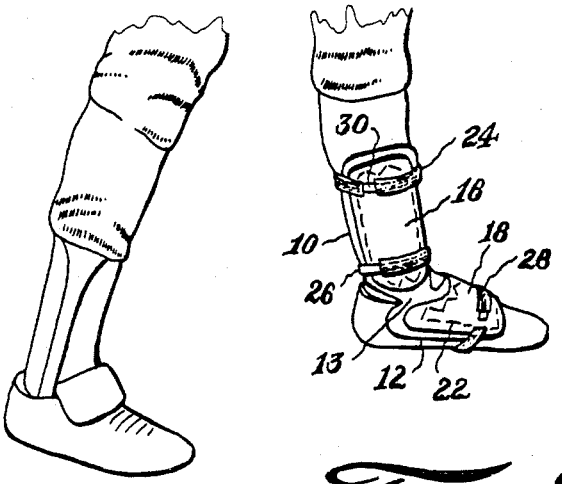
Figure 3:
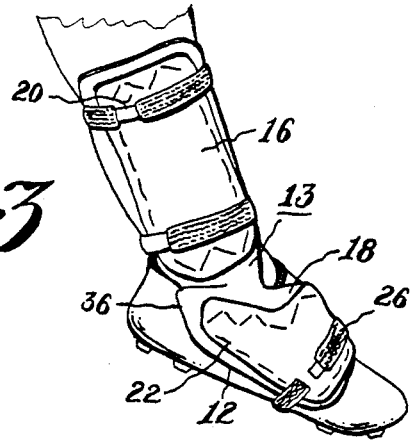
Figure 4:
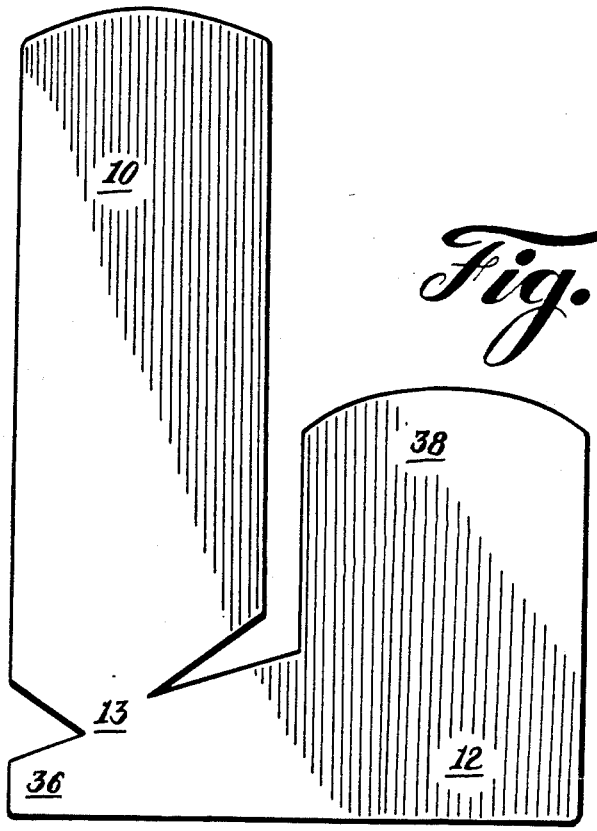

The foregoing and other objects, features and advantages of the invention as well as a presently preferred embodiment thereof will become more apparent from a reading of the following description in connection with the accompanying drawings in which:

FIGS. 1, 2 and 3 are perspective views showing an improved protector provided in accordance with the invention worn on the calf and foot of a right-handed batter; and FIG. 4 is a layout in a single plane or plan-form of the cushioning pad used to construct the protector shown in FIGS. 1, 2 and 3.

Referring to the drawings there is shown a protector which is designed for use by a right-handed batter. This protector should be worn on the calf and foot which faces the pitcher in the batting position, since this is the area which is likely to be struck by foul tips. The protector is made up of a pad or body of cushioning material (e.g. foam rubber), which has a first or upper section 10, a second or lower section 12, and a neck 13 between these sections which provides a flexible hinge. The upper or first section tapers downwardly to the neck as shown in FIG. 4. The foot section 12 extends laterally on opposite sides of the neck and also tapers downwardly to the lower end 14 thereof which extends to the toe area of the player.

First and second plates 16 and 18 of rigid material are attached as by sewing 20 and 22 to the upper and lower sections 10 and 12 of the cushioning pad. These plates may be made of material ordinarily used in fabricating casts which is known as "orthoplast". This material is softened by heating in water and then curved to conform to the shape of the calf and ankle in the case of the upper plate 16 and the foot in the case of the plate 18.

Straps 24 and 26 are secured to the upper plate 16. A strap 28 is secured to the lower plate 18. These straps are preferably in two parts. As shown in the case of the strap 24, there is a Velchro or hook binder strip 30 attached to the rigid plate 20. Another loose long strip 32 is also attached at one end to the plate 20 and has a Velchro part at the unattached or free end thereof. This Velchro part is then secured to the fixed Velchro strip on the plate. While Velchro is preferred other fastening means such as belts and buckles may be used if desired.

It will be observed that the upper section 10 extends over the calf and ankle while the lower section 13 has lobes 36 and 38 the lobe 38 extends over the instep and down to the toe while the lobe 36 covers the heel and arch area. The rigid plate 18 for the foot area is essentially "L" shaped and has a base region which extends to the toe and substantially covers the lobe 38 as well as a region which projects from the base region and forms an "L" shape therewith. This latter region covers substantially the lobe 36 and provides increased protection for the arch and other areas of the foot on the inside thereof.

As can be observed from FIGS. 1, 2 and 3 the protector does not interfere with the normal batting and running of the batter. FIG. 2 shows the protector on the batter in his normal batting stance. FIGS. 1 and 3 show the protector during various parts of the running cycle. It will be observed that the neck is flexible and hinges so as to prevent interference with running action.

From the foregoing description it will be apparent that it has been provided an improved protector for the calf ankle and foot of athletes and particularly baseball batters. While a presently preferred embodiment of the invention has been described, variations and modifications thereof within the scope of the invention, will undoubtedly suggest themselves to those skilled in the art. Accordingly the foregoing description should be taken as illustrative and not in a limiting sense.

I claim:

1. A calf, ankle and foot protector which comprises a flexible body of cushioning material with a first section for protecting the calf and ankle and a second section for protecting the foot and with a neck between said first and second sections providing a flexible hinge interconnection there between, said first and second sections and said neck all being connected in an integral assembly with each other, a first plate of rigid material having a curvature conforming to the calf being attached to said first section, a second plate of rigid material separate from said first plate having a curvature conforming to the foot being attached to said second section, said first and second plates being disposed on opposite sides of said neck, and means for attaching said first section and said first plate to the calf and for attaching said second section and said second plate to the foot leaving said neck free to flex with movement of said foot, ankle and calf.

2. The protector according to claim 1 wherein said first section tapers downwardly to provide portions disposable around said calf and said ankle.

3. The protector according to claim 1 wherein said second section has an upper portion which extends laterally forwardly and rearwardly from said neck and a lower portion which tapers inwardly.

4. The protector according to claim 1 wherein said first section tapers downwardly to provide portions disposable around said calf and said ankle and said second section has an upper portion which extends forwardly and rearwardly from said neck and a lower portion which tapers inwardly.

5. The protector according to claim 4 wherein said upper portion of said second section has a first lobe which extends from the heel to the toe over the arch of the foot and said upper portion also has a second lobe which extends over the instep of said foot.

6. The protector according to claim 5 wherein said attaching means are straps connected to said plates of rigid material.

7. The protector according to claim 5 wherein said first plate extends from a lower end over the ankle to an upper end along the calf.

8. The protector according to claim 5 wherein said second plate has a forward portion disposed over the instep and a rearward portion which extends over the arch of the foot toward the heel, said forward and rearward portions defining an "L" shape.

9. The protector according to claim 5 wherein said first plate extends from a lower end over the ankle to an upper end along the calf, and said second plate has a forward portion disposed over the instep and a rearward portion which extends over the arch of the foot toward the heel, said forward and rearward portions defining an "L" shape.

* * * * *